US005829214A

United States Patent [19]

Hart

[11] Patent Number: 5,829,214

[45] Date of Patent: Nov. 3, 1998

[54] METHODS OF SEALING ROOF DRAIN PIPES IN SINGLE PLY SYNTHETIC PLASTIC ROOF COVER SYSTEMS AND ROOF COVER SYSTEMS EMPLOYING SUCH DRAIN PIPE SEALING ASSEMBLIES

[75] Inventor: Timothy L. Hart, Grants Pass, Oreg.

[73] Assignee: Duro-Last, Inc., Saginaw, Mich.

[21] Appl. No.: 664,625

[22] Filed: Jun. 17, 1996

[51] Int. Cl.[6] ..... E04B 1/70

[52] U.S. Cl. ..... 52/302.6; 52/219; 52/302.1; 52/409; 52/741.4; 156/308.4; 285/42

[58] Field of Search ..... 52/218, 219, 302.1, 52/302.6, 408, 409, 410, 411, 741.4; 156/308.2, 308.4; 285/42, 189, 200

[56] References Cited

U.S. PATENT DOCUMENTS 4,504,352 3/1985 Meyer .
4,546,589 10/1985 Seaman .
4,779,899 10/1988 Williams .
5,145,617 9/1992 Hermanson et al. .

*Primary Examiner*—Carl D. Friedman
*Assistant Examiner*—Kevin D. Wilkens
*Attorney, Agent, or Firm*—Reising, Ethington, Learman & McCulloch, PLLC

[57] ABSTRACT

A roof system comprising a roof substrate with an exposed vertical, rigid drain pipe is covered by a flexible single ply synthetic, plastic cover, with a sandwiched reinforcement fabric, having an opening in alignment with the drain pipes. A patch-shaped piece of the cover material has a drain pipe accommodating opening surrounded by an edge portion perimetrally pressure-heat welded to the cover, the piece having a generally rigid, non-bindable, plastomeric seal ring disc, formed generally of recycled such cover material wherein the reinforcement fabric is disassociated and present in the plastic in the form of randomly dispersed fibres. The disc is only centrally pressure heat-welded to the underside of the piece and has an opening therethrough of substantially the shape and size of the drain pipe. It is the ring disc which is secured to the substrate.

18 Claims, 2 Drawing Sheets

METHODS OF SEALING ROOF DRAIN PIPES IN SINGLE PLY SYNTHETIC PLASTIC ROOF COVER SYSTEMS AND ROOF COVER SYSTEMS EMPLOYING SUCH DRAIN PIPE SEALING ASSEMBLIES

The present application is directed to methods and mechanisms for sealing roof drain pipes when a roof cover comprising a flexible single ply synthetic plastic membrane is to be applied as the external roof cover, either to existing buildings over existing roof covers or to new construction as the cover to be applied to the roof decking.

BACKGROUND OF THE INVENTION

Prior art systems for sealing membrane types of roofs to a depressed drain pipe or other drainage member have been of the type wherein a patch member incorporates an inverted stack which extends down into the drain pipe. Typically, such patches are pressure heat welded in place to the underlying roof membrane whose marginal opening edges they lap. Products of this type are shown, for example, in U.S. Pat. No. 4,779,899 and are in use in the field. It is necessary with this construction to employ some type of internal pressure ring to seal the inverted stack to the drain pipe internally, as disclosed in the aforementioned patent. The ring, obviously, takes up space within the drain pipe and this type of sealing structure is best used with larger diameter drain pipes.

Other systems in use in the field today involve cutting an opening of the size of the pipe in the membrane and then using exposed clamping bolts and an exposed upper metallic clamp ring to clamp the marginal edge of the membrane to the drain pipe. In this construction a sealant is used between the membrane marginal edge and a lower clamping ring drain flange.

SUMMARY OF THE INVENTION

The present invention is directed toward providing an improved method of sealing roof drains and the novel system for doing so. The object, with all such systems, is to provide a leak proof system which can be readily put in place in the field at the time of roof cover installation. The present improved system utilizes a synthetic plastic drain seal ring of a comparatively generally rigid character which can be factory heat pressure welded to underlie the marginal edges of a drain opening formed in a membrane drain patch. Because the seal ring is formed essentially from the same material as the membrane cover, although it is in a different recycled condition which provides a denser, more rigid and high strength body, a patch which is heat weldable to the cover membrane may be heat welded to the seal ring body to provide a leak proof relationship between the roof cover patch and the drain ring seal. The invention is expected to be particularly useful to seal the smaller diameter drain pipes to maintain good volume flows.

One of the prime objects of the present invention is to provide a seal incorporating drain patch construction of the character described which can be manufactured in the factory to insure a leak proof sealed relationship.

Another object of the invention is to provide a patch system which can be readily applied in the field without the necessity of utilizing an expanding and contracting ring within a drain boot which extends into the drain, and without using a clamp bolt arrangement with a clamp ring which is clamps externally relative to the membrane.

Still another object of the invention is to provide a very durable system of the character described wherein a disc ring fastener system is in a protected position which is not exposed to the atmosphere.

Another object of the invention is to provide a system of the type mentioned wherein a sealant bead forms an upper extension of the drain pipe.

Other objects of the invention are to provide an economical and versatile system which is very easy to install, and the design is such that it can be installed in a leak proof manner even by relatively unskilled workman.

Other and objects and advantages of this invention will become apparent with reference to the accompanying drawings and the accompanying descriptive matter.

THE DRAWINGS

The presently preferred embodiment of the invention is disclosed in the following description and in the accompanying drawings, wherein.

Figure 1:
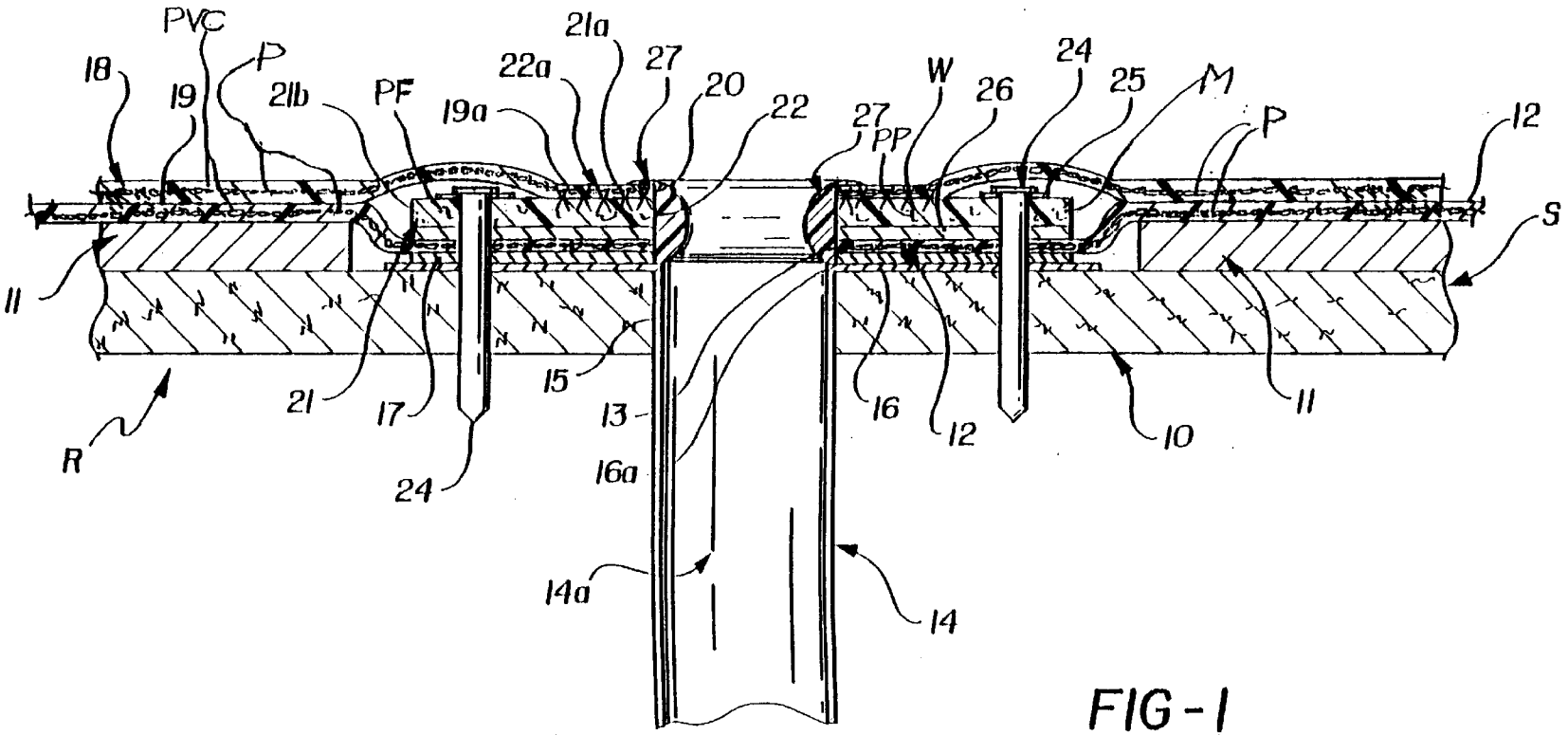
FIG. 1 is a fragmentary, schematic transverse cross sectional view through a roof system employing my improved drain sealing patch device.

Referring now more particularly to the accompanying drawings, a typical pre-existing roof system, generally designated R, includes a decking or substrate generally designated S which may typically be the roof system for a commercial generally flat roofed building in which purlins and the like are provided to support the roof system R in the usual manner. In the present case, the substrate S may be considered to be the original decking 10 and the cut away old roofing material 11 which is to be covered by the single ply plastic membrane 12.

The single ply roof cover 12 may, for purposes of illustration, be considered to be of the general nature disclosed in U.S. Pat. No. 4,546,589. Such widely marketed single ply synthetic plastic roof covers are typically fabricated in the factory to fit a particular roof. As such, the membrane system 12 will, at the time it is to be sealed to a drain, have an opening 13 cut therein which is gauged to the external diameter of the drain pipe 14 originally provided for the roof system R.

In the present case, the decking 10 is provided with an opening 15 to receive the drain pipe 14 which may preferably have a lateral flange 16 resting on the upper surface of decking 10. Typically, before the cover 12 is laid down over the flange 16, a sealant layer 17 is provided between the cover 12 and flange 16. The sealant used may be of the type which is viscously fluid when applied, and cures with time to a solid rubber-like state. It may be the well known polyurethane caulking sealant known as Vulkem 626 which may be procured from Mameco International Inc. of Ohio, a division of RPM Corporation. Where the term "sealant" is used throughout this specification it may be considered to be of this same brand, but it is to be understood that other sealants of a synthetic or natural variety may be used. While not deemed as satisfactory as the polyurethane sealant mentioned, pitch and tar sealants are possible, and so are silicone and other synthetic sealants.

Figure 2:
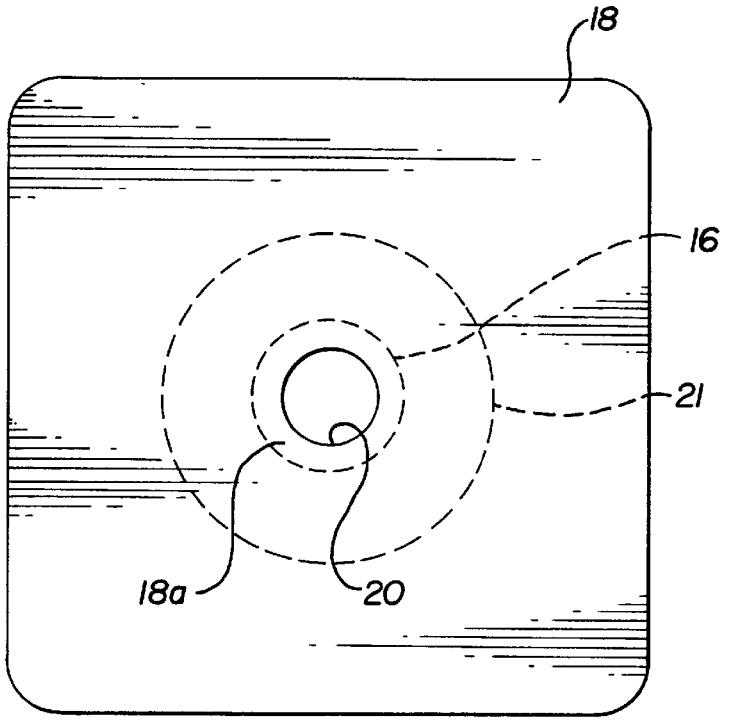
FIG. 2 is a top plan view of the patch only.
Figure 3:
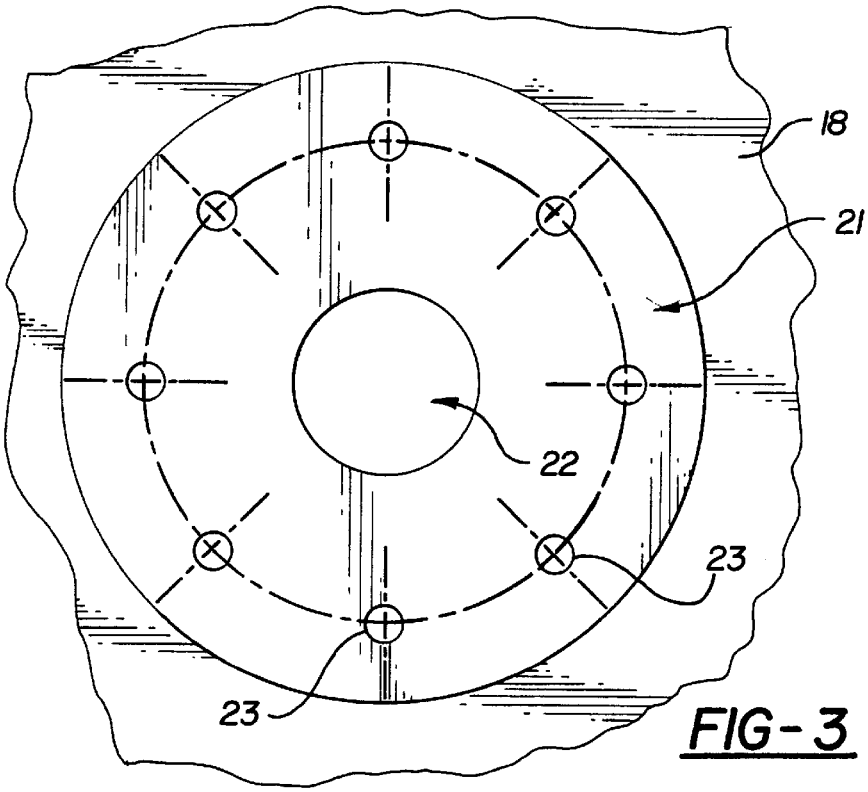
FIG. 3 is a fragmentary underplan view of the patch on an enlarged scale.

In FIGS. 2 and 3 in particular, I have shown the patch piece 18 which will be pressure heat welded to the cover 12 in a manner to be later described as at 19, as a final step in the installation operation. Preferably at the factory, an opening 20 is centrally cut in the piece 18 to correspond to the external diameter of pipe 14 and a comparatively generally rigid sealing disc ring 21, having a corresponding opening 22, is pressure heat welded to the patch piece 18 as at 22*a*. It is to be understood that the material composition of the flexible cover and flexible patch 18, which is canvas-like or fabric-like in pliability and foldability, and its equivalents, is disclosed in U.S. Pat. No. 5,145,617, which I incorporate herein by reference, and preferably constitutes a polyvinyl chloride coating PVC on opposite sides of a woven polyester fabric core P which reinforces the plastic and results in the composite strength which the membrane strips and pieces have. The disc ring 21 is formed in the manner described in U.S. Pat. No. 5,466,320, which I also incorporate by reference, essentially, or principally, of recycled roof cover material. The chemical and physical characteristics of the recycled material, I have found, are compatible for the purposes of heat weldability under pressure to the membrane cover material 12. It is, however, a denser more rigid material in which the fabric has been disembodied and the warp and weft strands largely disassociated so as to be present as discrete polyester fibres or filaments PF randomly dispersed in a polyvinyl chloride matrix, M such as described in the U.S. Pat. Nos. 5,145,617 and 5,466,320. While polyvinyl chloride is the synthetic plastic of choice, and polyethylene terephthalate polyester is the fabric and fiber of choice, it is thought that the plastic coatings, for example, could be one of the other polyolefins such as polypropylene. Other possible alternatives for the plastic coatings and the core fabric are set forth in the aforementioned U.S. patents.

It will be noted that the patch material 18 is only welded to the disc ring 21 along its marginal edge portion 18a surrounding opening 20. The width of this preferably dielectric radio frequency weld which extends from opening 20 is indicated in FIG. 2 by the marginal line "x". The welded area is slightly depressed due to the pressure used in effecting the weld. Prior to using the pressure, the area 18*a* and 21*a* of the patch 18 and disc 21 are heated to liquify their immediate surfaces and create the weld material which ultimately joins them. This weld material, incorporating disk surface material as well as patch surface material, provides a very strong leak proof bond at W. The portion 18*a* welds to the mediate portion 21*a* of disc 21 so as to leave the edge portions 21*b* of the disc free of, or separated from, the patch material 18. As FIG. 3 indicates, a plurality of openings 23 are provided in the edge portion 21*b* of the disc 21 for the purpose of accommodating the screw fasteners 24 which are shown in FIG. 1. The screws 24 may be provided with washers 25 and, when installed, extend into the decking 10 and any underlying support members. Another layer of sealant 26 is provided between the disc 21 and the cover member 12, and it will be seen that an annular bead of sealant 27 is also provided to form what amounts to an upper extension of drain pipe 14, closing the marginal edges of the openings in the patch 8, disc 21, and cover 12. Because all of these openings are of slightly greater diameter than the interior diameter of drain pipe 14, a shelf portion 16*a* is provided for the bead 27 which, it will be noted, also is spread to rest on the marginal top surface of the patch 18. As FIG. 1 indicates, the disc 21 will typically be at least twice the thickness of the membrane material designated at 18 and 12, and the fasteners screws 24 are situated in protected position underneath the patch material 18 between welded portions 19 and 19*a*. The disc 21 is not materially pliant nor foldable. It is firm and returns to its shape if it is deformed.

In operation, water spills over the surfaces 12 and 18 to the interior 14*a* of drain pipe 14. A wire leaf capturing device or strainer may be provided to seek to prevent leaves and the like from entering the drain pipe 14 in the usual manner.

THE INSTALLATION

As previously indicated, the patch 18, with the disc 21 welded thereto, is provided to installers in the field along with the dimensionally prefabricated strips which form cover 12. The pressure heat weld of the disc 21 to patch 18 can be accomplished at the factory dielectrically most economically and expeditiously to provide a high quality, leak proof weld. Various patches can be maintained in inventory, dependent on the diameter of the drain pipe.

Typically, the improved assembly is especially useful for the smaller diameter drain pipes. With the sealant coat 17 laid down first of all, and covered by the membrane 12, the next step is to apply the sealant coat 26 and lay the patch 18 with its flat disc ring 21 in position vertically aligned with the pipe 14 and the opening 13 cut in the cover 12. The patch material 18 can then be folded upwardly as far as its welded portion 19*a* to permit the screw fasteners 24 to be inserted through openings 23 and threaded downwardly through the membrane fabric 12 and flange 16 into the substrate S decking 10. Once all fasteners 24 have been secured, the patch fabric 18 can be dropped or folded down to the lapped position shown in FIG. 1, and heat pressure welded as at 19 to the membrane cover 12. Typically, the lifting and dropping of the free edge portions of patch 18 is progressively effected as the fasteners 24 are secured. Heat pressure heat sealers, of the type disclosed in U.S. Pat. No. 4,504,352, for example, are well known and available to permit the heat welding of the patch 18 to the cover 12 to then be accomplished on the roof.

It is to be understood that the embodiments described are exemplary of various forms of the invention only and that the invention is defined in the appended claims which contemplate various modifications within the spirit and scope of the invention.

I claim:

1. A roof system comprising a roof substrate with a generally vertical opening and a generally vertical, rigid drain pipe situated in said opening, and incorporating:

a. a flexible single ply synthetic, plastic cover comprising a reinforcement fabric with a synthetic plastic coat on each side, secured over said substrate and having an opening therein substantially in vertical alignment with the drain pipe;

b. a patch-shaped piece of heat weldable material, having a mediate portion with a drain pipe accommodating opening corresponding substantially to the size and shape of said drain pipe, and surrounded by an edge portion perimetrally pressure-heat welded to said cover, the piece having a plastomeric seal ring disc, formed generally of a synthetic plastic with randomly dispersed fibres which enhance its strength and durability, pressure heat-welded to the underside of said piece, the disc having an opening therethrough of substantially the shape and size of said drain pipe and being secured to said substrate.

2. The system of claim 1 wherein a sealant layer is provided between said disc and cover, and between said cover and substrate.

3. The system of claim 1 wherein said disc has a mediate portion, and an outboard edge portion, and is pressure heat welded to said piece only in said mediate portion around said opening in the disc to leave the edge portion of the disc free of said piece, the disc having a plurality of fastener openings in said edge portion of the disc, and fastener members extending from above said disc but under said piece through said disc fastener openings to anchor said disc to the substrate.

4. The system of claim 1 wherein said openings in the piece, the disc, and the cover have marginal edges and a perimetral bead of sealant material is applied to seal the marginal edges of said openings in the piece, the disc, and the cover, and seal also the upper part of said drain pipe.

5. The system of claim 1 in which said substrate includes a layer of existing roof material cut away to expose an area of a lower substrate layer surrounding said roof drain pipe.

6. The system of claim 5 in which said drain pipe has a lateral flange received on said lower substrate layer within said cut away area.

7. The system of claim 6 in which said openings in said piece, said disc, and said cover are of substantially the diameter of the exterior surface of the drain pipe to provide an inset surrounding area on said flange for receiving said bead of sealant.

8. The system of claim 1 wherein said plastic is polyvinylchloride and the fabric is a polyester.

9. A roof drain pipe sealing patch which can be pressure heat welded to a single ply synthetic plastic roof membrane having a sandwiched reinforcement fabric core comprising:

a. a patch sized piece of said membrane with an opening corresponding to the size of the drain pipe cut therein; and b. a generally rigid ring disc formed generally of synthetic plastic material with fibers randomly dispersed in the plastic material and which is of less size than said piece, the disc having a mediate portion surrounded by an edge portion and the mediate portion only being heat pressure welded to the underside of said piece.

10. The patch of claim 9 wherein said disc is dielectrically radio frequency welded to said piece.

11. A method of sealing roof drain pipes in roof systems wherein a substrate has a generally vertical opening vertically aligned with a generally vertical drain pipe, and a flexible synthetic plastic membrane comprising a reinforcement fabric with a synthetic plastic coat on each side is applied as an external roof cover, the cover having an opening to align with the drain pipe cut therein, comprising the steps of:

a. applying said cover membrane to said substrate with said cover opening vertically aligned with the drain pipe;

b. laying a patch-shaped piece of cover membrane material, which is cut with an opening of substantially the size of the drain pipe, and whose edge portions will lap the opening in said cover sheet, to cover said opening in said cover membrane, the piece having a generally rigid plastomeric seal ring disc pressure heat welded to the underside of said piece only centrally around a drain opening provided in said disc to leave non-attached perimetral edge portions of said disc;

c. exposing edge portions of said disc and securing fasteners to extend from said disc into said substrate; and d. arranging the edge portions of said piece in lapping relation with said membrane cover perimetrally, and then heat welding the lapping edge portions of said piece to the roof cover membrane.

12. The method of claim 11 wherein a layer of sealant material is applied between the roof cover membrane and substrate before steps b through d are performed.

13. The method of claim 11 wherein a layer of sealant material is applied between the roof cover membrane and disc before said disc is fastened down.

14. The method of claim 13 wherein a bead of sealant material is applied marginally around said openings in the cover membrane, the piece, and the disc and extends to the upper end of said drain pipe to function as an upper extension of the drain pipe.

15. The method of claim 14 wherein said plastic is polyvinyl chloride and the fabric is a polyester.

16. The method of claim 14 wherein said drain pipe has an upper lateral flange resting on said substrate and said openings in the cover membrane, piece, and disc are cut larger than the internal diameter of said drain pipe to provide an exposed shelf portion on said flange on which the bead can rest.

17. A method of making a drain pipe sealing patch for a single ply, synthetic plastic roof membrane having a sandwiched reinforcement fabric core comprising:

a. fabricating a patch sized piece of membrane material with an opening corresponding to the size of the drain pipe;

b. fabricating a plastomeric ring disc formed generally of synthetic plastic material with fibres randomly dispersed in the plastic material and which is of less size than said piece, the disc having a mediate portion surrounded by an edge portion and having a drain pipe sized opening provided in its mediate portion; and c. pressure heat welding only said mediate portion to the underside of said piece.

18. The method of claim 17 wherein a series of perimetrally spaced fastener openings are provided in the edge portion of said disc.

* * * * *